US007377364B2

(12) United States Patent
Tyni et al.

(10) Patent No.: US 7,377,364 B2
(45) Date of Patent: May 27, 2008

(54) ELEVATOR ARRANGEMENT

(75) Inventors: Tapio Tyni, Hyvinkää (FI); Jari Ylinen, Hyvinkää (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/603,173

(22) Filed: Nov. 22, 2006

(65) Prior Publication Data

US 2007/0151809 A1 Jul. 5, 2007

Related U.S. Application Data

(63) Continuation of application No. PCT/FI2005/000225, filed on May 18, 2005.

(30) Foreign Application Priority Data

Jun. 28, 2004 (FI) ..... 20040891

(51) Int. Cl.
*B66B 1/16* (2006.01)

(52) U.S. Cl. ..... 187/380; 187/391; 187/396

(58) Field of Classification Search ..... 187/391–396, 187/247

See application file for complete search history.

(56) References Cited

U.S. PATENT DOCUMENTS 6,202,799 B1 * 3/2001 Drop ..... 187/388
6,615,175 B1 * 9/2003 Gazdzinski ..... 704/275
6,986,408 B2 * 1/2006 Takeuchi ..... 187/380
2006/0144644 A1 * 7/2006 Chiba ..... 187/380

* cited by examiner

*Primary Examiner*—Jonathan Salata
(74) *Attorney, Agent, or Firm*—Birch, Stewart, Kolasch & Birch, LLP

(57) ABSTRACT

The present invention deals with a method and an apparatus for the input call needed in an elevator system by means of a wireless call input device. The call input device may be a device provided with a display and a keypad, designed especially for this use. In a preferred embodiment, the call input device is the user's mobile telephone and the system utilizes technology consistent with the Bluetooth standard. RFID technology or the use of bar codes is also possible. For the user a profile is created which contains the user's name, statistical information regarding the destination floors most frequently selected by the user, and possible additional services. The user can input a call from an elevator lobby before arriving to the elevator. After the system has allocated the most suitable elevator to the user, corresponding information is presented on the display of the call input device. This information can be accompanied by guidance information and information about an estimated waiting time. The destination floor alternatives can also be programmed to the call input device by the user him/herself. Additional services can be provided to the user of the call system and to other parties working in the building by connecting the control system to the Internet e.g. via an embedded mobile telephone.

41 Claims, 3 Drawing Sheets

ELEVATOR ARRANGEMENT

Figure 1:
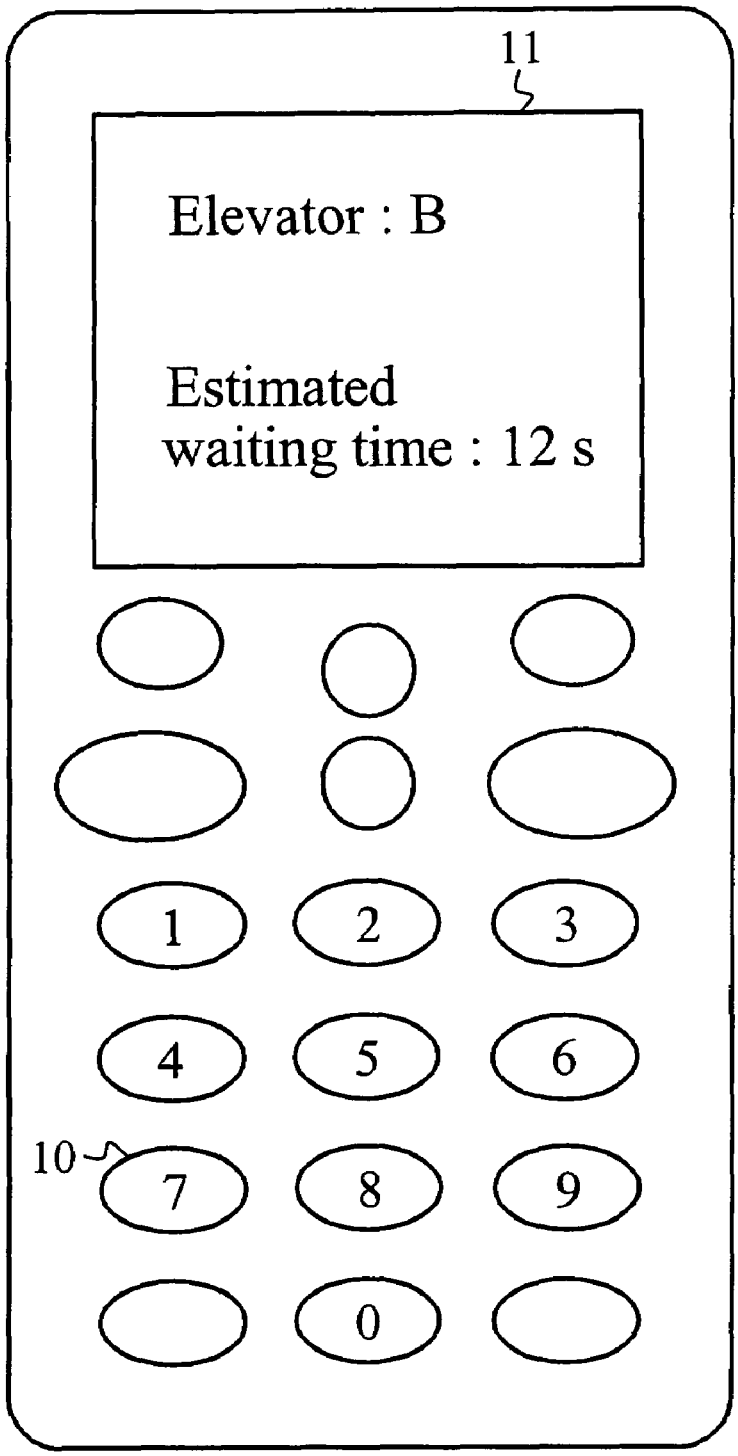

This application is a Continuation of copending PCT International Application No. PCT/FI2005/000225 filed on May 18, 2005, which designated the United States, and on which priority is claimed under 35 U.S.C. § 120. This application also claims priority under 35 U.S.C. § 119(a) on Patent Application No(s). 20040891 filed in Finland on Jun. 28, 2004. The entire contents of each of the above documents is hereby incorporated by reference.

FIELD OF THE INVENTION

The present invention relates to call input in an elevator system. In particular, the present application describes a method and an apparatus for call input and wireless programming of a device.

BACKGROUND OF THE INVENTION

A passenger using an elevator system has to let the control system of the elevator system know both his/her own arrival floor and the destination floor the passenger wants to reach. Traditionally, the passenger gives this call information by a two-step procedure such that, on the arrival floor the passenger first gives a landing call typically by means of arrow buttons and then, after an elevator has arrived at the customer's departure floor, the customer gives the system his/her destination floor information by pressing a car call button in a control panel in the elevator car. Due to its two-step nature, the traditional system requires the passenger to input two separate calls for one elevator ride, unless the elevator originally happens to be at the passenger's arrival floor or unless another person traveling in the same direction has input a landing call.

The number of calls to be input for one elevator trip can be reduced to one by using a so-called destination call system. Such a system is widely known and a system of this type is described e.g. in U.S. Pat. No. 3,374,864 granted already in 1968. In the destination call system, the passenger gives a destination floor call while still outside the elevator on a landing floor. On the basis of this single call, the elevator system allocates the most suitable elevator to the customer, and when the customer enters the elevator car no separate destination call needs to be given in the car.

Specification U.S. Pat. No. 4,655,324 describes a method and an apparatus for the input of calls to an elevator system via a wireless and portable transmitter. In this system the call is registered in the same way as if the call had been input from a traditional car control panel. The call input device has a keypad with keys that can be used to select a destination floor or give a special command to the elevator system. The receiver and its antenna may be placed in the car call panel if only calls given wirelessly in the elevator car are to be accepted. In the method of specification U.S. Pat. No. 4,655,324, wireless input of calls from outside the car from an elevator lobby is also mentioned. Elevator users have a personal "remote controller", by means of which it is possible to give the destination floor already in the elevator lobby or while approaching the lobby. Placed in the lobby is also a receiver, which in this case transmits the call data to the elevator control system.

Specification U.S. Pat. No. 6,223,160 discloses a portable apparatus that can be used to input a call to an elevator system. The apparatus comprises input equipment, comprising a display and a keypad, that can be fastened e.g. to the user's wrist like a wrist watch. Included in the input equipment is an audio unit, which may comprise a microphone and a loudspeaker. The customer can input a call by vocally naming his/her destination floor, and the input equipment registers this acoustic signal. The received signal is converted into an electromagnetic signal, which can be sent by a separate transmitter. This signal can be received by a destination call terminal which is provided at the landing floor and which can also be used to input traditional destination calls in the same way as in destination control. From the destination call terminal, the call data are transferred further to the elevator control system. Over a wireless link, it is also possible to transmit information in the other direction. In this case, e.g. in elevator systems consisting of multiple elevators, the identifier (e.g. a letter code) of the elevator arriving to the customer can be shown on the display of the wrist device.

A problem with prior-art solutions is that the user interface is identical in all buildings used by the customer. Regardless of the locality where the elevator system is situated, the user has to key in the number of the destination floor via a traditional numeric keypad from zero to nine. Prior-art solutions do not use so-called single-key quick selection for selecting the destination floor because this would make the equipment dependent on the number of floors in the building. Thus, the problem with prior-art solutions is a lack of adaptability to different buildings, and this results in a low level of user friendliness of the call input equipment.

OBJECT OF THE INVENTION

The object of the present invention is to disclose a portable call input device and a method for wireless input of calls in an elevator system. The call input device allows building-specific quick selection and simple programming of shortcut selections.

BRIEF DESCRIPTION OF THE INVENTION

The present invention discloses a method and an apparatus for the input of elevator calls via a portable call input device. Quick selection alternatives can be defined for the call input device, and the selection alternatives can be programmed to the device. In one embodiment, Bluetooth technology is used as the user interface of the elevator system and the call input device is the user's mobile telephone. As another embodiment, REID technology can be utilized in the communication between the call input device and the elevator system control. One embodiment of the invention is the use of bar codes in the call input device the use of a bar code reader device connected to the system control.

An embodiment of the method of the invention comprises establishing a connection between a wireless terminal of the person inputting the call and the control system of the elevators. Once connection is established, the person inputting the call is identified by selecting the user profile of the person inputting the call from the control system and their departure floor is determined. The control system then transmits to the terminal those parts of the user profile that contain building and departure floor specific destination floor alternatives. The user may then select one of the destination floor alternatives presented and transmit that selection back from the wireless terminal to the control system, which then allocates an elevator.

In an embodiment of the method of the present invention, a connection is established between the wireless terminal of the person inputting the call and the control system of the elevators. The connection can be established e.g. when the user arrives in the elevator lobby. For establishment of the connection, there are one or more base stations placed in the lobby on each floor, said base stations being connected to the control of the elevator system and used to establish a wireless connection to the terminals. The owner of the call input device is identified and after this the system control starts using a user profile concerning the user in question. Stored in the profile are e.g. the user's name, statistical information regarding the destination floors most frequently selected by the user on the departure floor and in the building in question, and data indicating activated additional services. The profile also takes into account the building (number of floors and floor name information) where the user is.

In an embodiment, the names of the quick selection alternatives are transmitted to the call input device. These preselections can be defined as the user's most favored destination floor selections considered from the departure floor in question. The preselection alternatives are given specifically for each building and they can be assigned illustrative designations on the display of the call input device.

The user can give his/her destination floor selection in the elevator lobby already before coming to the vicinity of the elevator. The destination floor selection is combined with the departure floor data obtained from the location of the terminal and this pair of call data items is transmitted to the elevator control system for elevator allocation.

An embodiment of the system of the invention comprises at least one elevator, an elevator control system, a wireless terminal used to call an elevator, and a base station for establishing a connection and transmitting information between the wireless terminal and the elevator control system. Identification data containing a user profile is transmitted between the wireless terminal and the elevator control system. The wireless terminal is also equipped with a means for calling an elevator by selecting a destination floor, and a means for transmitting data to and receiving data from the elevator control system.

In an embodiment of the present invention, the call is input by briefly depressing a button on the terminal. The programming of a new destination floor as a quick selection alternative on the call input device is effected by depressing a desired quick selection button by a long depression when the user is on the desired destination floor. Alternatively, the programming can also be effected elsewhere than in the building whose floors are being programmed. In this case, the identifier of the building has been sent previously to the terminal in a situation where the terminal was situated in the building in question. By using the identifier, the quick selection buttons can be programmed independently of the place of programming.

Once the call has been processed and an elevator has been allocated to serve it, information regarding the elevator to serve the call is transmitted to the display of the user's terminal. This information can be combined with information guiding the user to the elevator in the case of large elevator lobbies, and in addition an estimated waiting time can be communicated to the user. In the user profile, it is possible to activate additional services, such as e.g. a handicapped user service for handicapped persons.

In an embodiment utilizing RFID technology, the call can be input by closing the desired one of a number of resonant circuits by means of a bubble switch. In this way, the resonant circuit acts as a transponder while the RFID transmitter connected to the system control functions as a reader device.

In an embodiment of the present invention, the call input device may be a card-type device with a number of bar codes. In this case, the reader device of the system is a bar code reader. A call is input by showing the desired code to an optical reader while covering the other codes visible on the card.

In the present invention, Bluetooth technology can be utilized by providing to the user many services related to the use of elevators. This becomes possible by connecting both the control system and the call input device to a network providing services, e.g. to the Internet. Via the Internet, the elevator control and call system can communicate with other functions available in the building.

Other embodiments of the invention are also presented in the description and drawings of the present application. The inventive content may also comprise several separate inventions, especially if the invention is considered in the light of explicit or implicit sub-tasks or in respect of advantages or sets of advantages achieved. Within the framework of the basic concept of the invention, features of different embodiments of the invention can be applied in conjunction with other embodiments.

LIST OF FIGURES

Figure 2:
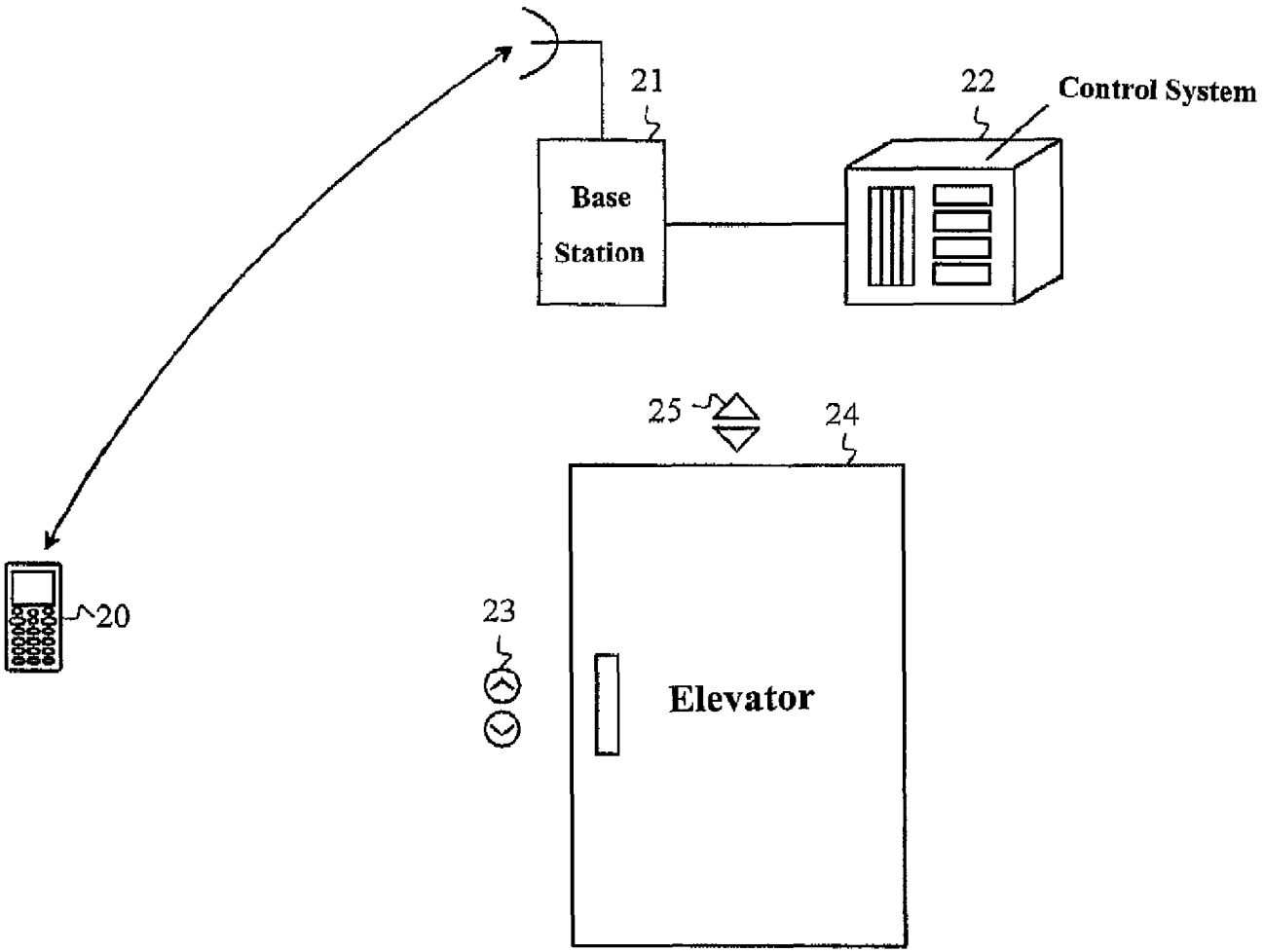
Figure 3:
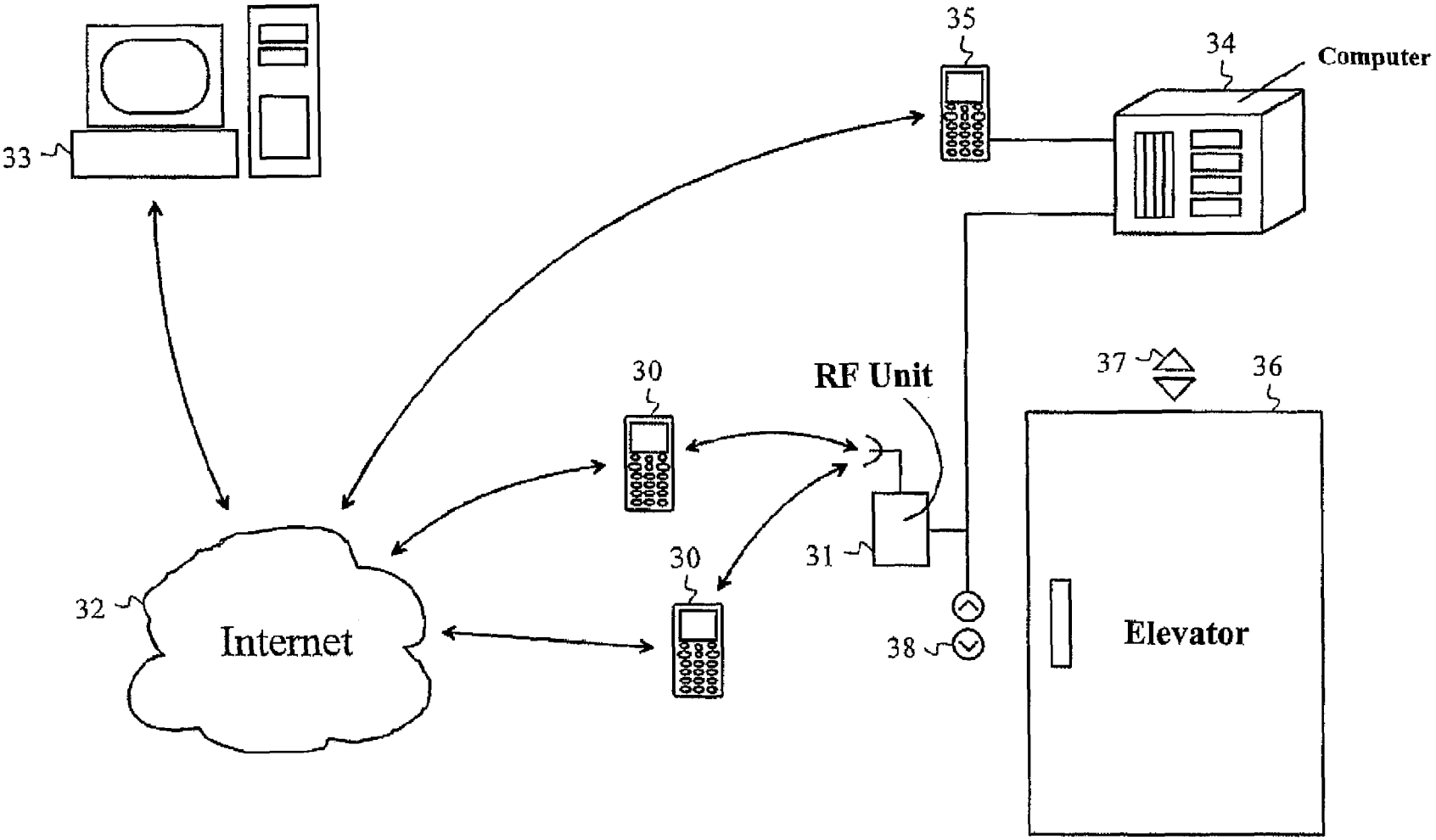

FIG. 1 presents an example of the call input device of the present invention when an elevator has been allocated to a call given via the call input device, FIG. 2 presents an example of the wireless call input equipment of the present invention, and FIG. 3 presents an example of an elevator call input apparatus according to the present invention using Bluetooth technology.

DETAILED DESCRIPTION OF THE INVENTION

The present invention discloses a method and an apparatus for the input of a call in elevator system by means of a portable call input device. An example of the call input device is a mobile telephone, but it is also possible to use as a call input device e.g. a portable device specially designed for this purpose. The size of the call input device is approximately of the order of the size of existing mobile telephones.

FIG. 1 presents an example of a call input device, which in this case is the elevator passenger's mobile telephone. Essential parts comprised in the call input device are a keypad 10 and a display 11. The keypad 10 of the mobile telephone serves as quick selection buttons of the call input device. A call input device of a different type may contain a desired number of quick selection buttons instead of the conventional numeric telephone keypad, and the destination floors most frequently used by the user are programmed to the buttons. The programmed floors can be set e.g. in a building-specific manner, so for example an 'Exit' button may stand for a different floor in different buildings. The quick selection buttons can be programmed in a simple way, which will be described in more detail later on.

An example of the call input equipment for an elevator system according to the present invention is presented in FIG. 2. The passenger using the elevator system of the building in question possesses a portable call input device 20, which in a preferred embodiment is a mobile telephone. Each floor in the building is provided with a base station 21, which can communicate with the call input device 20. The antenna of the base station 21 is so placed and oriented that it can receive the signal sent by the call input device 20 from those areas in the elevator lobby where customers typically move when arriving to the elevator. Essential components of the call input device 20 are a display, programmable quick selection buttons and a transmitter-receiver unit, of which the last-mentioned component may be e.g. an infrared transmitter-receiver or a radio transmitter-receiver. The base station 21 correspondingly contains a transmitter-receiver capable of communicating with a plurality of call input devices so that it is able to handle signals sent simultaneously by several call input devices.

The base station 21 is connected to the elevator control system 22, which contains a processor that performs the allocation of elevators. The base station 21 processes the received call data into a form that the control system 22 is able to understand. The system additionally also comprises up-down call buttons 23 as are normally used for the input of traditional landing calls, and car call buttons inside the elevator car. The system may also be provided with e.g. a so-called destination call system, where the passenger can use a so-called DOP (Destination Operating Panel) to give a destination floor call already on the landing before entering the car. Those passengers who have a portable call input device 20 use it for call input. Other passengers give a landing call in the traditional manner by pressing the up-down call buttons 23 and a car call via the car call panel.

When an elevator customer carrying a call input device 20 presses a call button, the call input device 20 and the base station 21 establish a connection permitting two-way data transfer. Each base station 21 on a floor in the building knows the name information designating the building where the base station is situated, as well as the floor on which it is located. When the passenger gives a call by pressing a quick selection button (e.g. an 'Exit' button), a communication cycle is started between the call input device 20 and the base station 21. In a preferred embodiment, during this communication cycle started by the call input device 20,

- the base station 21 tells the call input device 20 the building name and floor identifier for the building and floor where the call input device 20 is located at the moment
- the selection alternatives behind the quick selection buttons of the call input device 20 are replaced with the destination floor selection alternatives for this particular building, which have been previously programmed by the user
- when the quick selection button is released after a short depression, the call input device 20 sends to the base station 21 the destination floor data corresponding to the button and in response to the call input the call input device 20 can give the user a short sound signal,
- the base station 21 combines the destination floor data with data indicating the floor of its own location, i.e. the floor from which the call was issued
- the base station 21 transmits the pair of call data items 'call input floor, destination floor' to the elevator control system 22.

After the control system 22 has made a decision regarding the elevator to serve the call and transmitted this information to the base station 21, a second communication cycle, started by the base station 21, begins, during which

- the call input device 20 having sent the call receives information regarding the elevator 24 serving the call.

The call input device 20 can give a sound signal and display the number or other code identifying the elevator 24 serving the call. In buildings containing several elevators, this allows the user to move beforehand to the right elevator and wait in front of it. The elevator 24 to serve the call can also be indicated using traditional light indicators 25 above or beside the elevator door to indicate the elevator having arrived and its direction of departure. When the elevator customer boards the elevator 24, the destination floor call has already been input (the light indicator for the desired destination floor is lit), so the customer need not give a new call in the elevator car. In this sense the present invention is like a remotely operated destination call system. At this juncture, the base station 21 can transmit useful information, such as an estimated elevator waiting time, to the display of the customer's call input device 20.

In the programming of the quick selection buttons of the call input device 20, indirect use is made of the user interface used for call input in the elevator system. When the customer wishes to program a new destination floor in a given building for a quick selection button, he/she will normally ride on an elevator to the destination floor in question using the call input device. Having reached the destination floor, the user presses the desired quick selection button by a long depression. This depression starts a communication cycle between the base station 21 and the call input device 20, wherein

- the base station 21 sends the call input device 20 information giving the building name and floor data for the building and floor where the call input device 20 is located at the moment
- the information behind the quick selection buttons of the call input device 20 is replaced with the information regarding the destination floors in the building in question, which have been previously programmed by the user
- when the quick selection button is released after a long depression, the floor data received from the base station 21 is stored on the relevant quick selection button of the call input device 20.

In this case, no call is sent from the call input device 20 to the base station 21. It is to be noted that the stored destination floor data is building-specific. Thus, destination floors stored in building A have no effect on destination floor alternatives stored by the customer in building B. After the information has been stored, a destination floor thus stored can be selected in the manner described above.

The destination floor alternatives can also be programmed in another way. In this example the programming can also be carried out elsewhere than in the building whose floors are being programmed. First, the holder of the call input device 20 must visit the building which is to be programmed later. In this situation, when the call input device 20 is located within the range of a base station 21, the call input device 20 receives via the base station 21 the building identification data from the system control 22. In addition to this unambiguous identification data, it is also possible to transmit other information specifically relating to the building, such as information regarding the number of floors in the building and possible special floor designations. When the holder of the call input device wishes to program desired destination floor alternatives in a desired building, he/she can do this outside the building, e.g. at home. In this case, the programmed information is stored on the call input device 20, and thus no connection to the base station 21 is needed. Via the user interface of the call input device 20, the user selects the identification data (which may consist of e.g. the name of the building) on the basis of which is selected the building for which the programming is to be performed. During the actual programming, the user interface asks the user to give the shortcut key to be programmed and the destination floor to be programmed and returns feedback telling whether the programming in the memory of the call input device 20 was successful. The programming can be repeated until all desired preselection alternatives have been stored on the call input device 20. After this, destination floor calls are input as above, by pressing a quick selection button in the building in question.

An example of the present invention involves the use of RFID technology. A RFID system typically comprises a reader device and several transponders, i.e. identification signals. When a transponder arrives within the field transmitted by the reader device, the transponder sends the information stored on it to the reader device.

In an elevator system, RFID technology can be used by placing a reader device in the elevator lobby. The elevator user again has a call input device. In this embodiment example, the call input device used is an access card, which contains two or more RFID resonant circuits. Each RFID resonant circuit contains a switch that can be used to close the current circuit. When the resonant circuit is closed, the circuit works like a RFID transponder. In a preferred embodiment, the access card contains four RFID resonant circuits and four bubble switches integrated in it, and the desired resonant circuit can be selected by pressing the relevant switch. For each bubble switch, the user can program desired destination floors as described above. When walking past a remote reader, the user presses the bubble switch corresponding to the desired destination floor, and in this way the destination call is transmitted to the elevator control system.

The card can be provided with a personal identifier, which is transmitted to the elevator control system together with the call data. This allows the use of special functions; for example, in the case of a handicapped customer the elevator door can be held open for a somewhat longer time than usual. An application related to personal identification is identification of a priority call. Access to a given floor can be allowed only to desired persons. One possibility is to provide faster elevator service to priority customers than to others, in other words, a priority customer's call is served first regardless of other active calls.

In the case of an access card provided with bubble switches used in a low-rise building, each floor can be set behind a separate switch. In higher buildings, it is naturally necessary to follow the above-described procedure, by having the most favored destination floors programmed beforehand on the card e.g. by the elevator passenger or the operator of the elevator system.

An example of the present invention is the use of bar codes to implement the call card. In this embodiment, the card can be provided with four bar codes, with two bar codes placed on either side of the card. In this embodiment example the remote reader is a bar code reader like those used e.g. with cash machines in grocery stores. The call card can be used so that the customer arriving to the elevator shows the card to the reader while covering with his/her hand one of the bar codes on the same side of the card. Such a card contains four different floor selection alternatives, but it is also possible to place more bar codes on each side of the card. On the other hand, the number of different bar codes that can be placed on one card without impairing its usability can be influenced by the design of the card.

The card according to the embodiment example may be a building-specific or a general-purpose card. In the case of a general-purpose card, the floors have to be programmed e.g. in such a way that a given bubble switch or bar code always stands for that floor to which the user arriving in the building is going (e.g. the floor on which the user is living, or the floor on which the workroom at the job is located) and similarly another bubble switch or bar code always means the exit floor or lobby floor of the building. As the number of bubble switches in the present invention may be other than two or four, the programming can also be performed in some other appropriate way.

An example of the present invention is to utilize the so-called Bluetooth technology. Bluetooth is a standard that deals with local wireless data transfer in a mobile telephone environment. The standard is based on low-cost and short-range wireless connections. In Bluetooth technology, many wireless and wired devices of different types can be connected to each other via a wireless link. The radio frequency band used is 2.4-2.4835 GHz, which is an unlicensed frequency range intended for ISM applications. The transmitter-receiver uses frequency hopping, which reduces the effect of disturbances. The maximum hopping rate may be 1600 hops per second, and the number of different frequency channels is 79, spaced at 1 MHz between channels. Data transfer is packet-based and typically the transmitter changes the transmitting frequency after the transmission of each packet. The transmission power is typically 1 mW, which allows a 10 m link distance between transmitter and receiver. However, the transmission power can be increased up to 100 mW, which allows a link distance of even 100 m. Bluetooth supports asynchronous data transfer, where the data transfer rate in one direction is 721 kb/s while the data transfer rate in the return direction is 57.6 kb/s.

Piconet means a link and network consistent with Blue tooth technology, created for temporary use between different devices. A piconet may typically consist of e.g. a mobile telephone and a PC. In a piconet, one device is called a master, to which the other devices (slaves) are subordinated. The clock signal controlling the system is obtained e.g. from the master device. Several piconet networks can be connected together, and these networks can be distinguished by the fact that each network has its own frequency hopping sequence.

Bluetooth is an open standard, so it enables applications created by a third party, which can be successfully utilized in a Bluetooth system. The call system of the present invention is such an application. Bluetooth technology makes it possible for a mobile telephone within the area of the network to know its location, and this feature can be utilized to provide to the user of the mobile telephone services available in this area.

As an embodiment of the present invention, the elevator system can be equipped with Bluetooth radio units and each user of the elevator system can be offered a personal interface for the input of elevator calls. Service is improved, and Bluetooth also gives a possibility to bill the customer for this improved service. Bluetooth enables wireless input of calls via a mobile telephone as described above as well as building-specific programming of calls.

An example of a solution according to the present invention utilizing Bluetooth technology is presented in FIG. 3. A passenger carrying his/her own mobile telephone 30 arrives in the elevator lobby, where several such telephones may be present at the same time. Each floor served by the elevators is provided with a low-power RF unit 31 enabling data transfer between the elevator system and the mobile telephone 30. The passenger can download a user interface application from the elevator manufacturer's server 33 via the Internet 32. After being registered as a user of the interface, the customer's mobile telephone is able to establish a connection to the elevator group control system 34. During the downloading and registering process, the user is asked for identification information and the user is given a username, which will be used subsequently to identify the user. In principle it is also possible to bill the user of the service for the registration. Once the user has his/her own username, he/she can create a personal user profile on the server 33 and also change the profile later. In the profile it is possible to activate various services. As an example, a handicapped person can be provided a service for handicapped passengers whereby a call given by the user is treated in the control system as a special call. A special call can be afforded faster than normal service, or elevator allocation can be effected taking into account that a passenger in a wheel chair needs more space in the elevator car. The system gives a possibility to grant the username for a defined period, i.e. the username may be valid for a period of desired length.

Thus, a registered user is able to input calls via his/her mobile telephone 30. Each elevator group has a separate identifier. The identifier makes it possible to know the elevator group in whose area the customer is moving. The floor can be determined on the basis of the floor to whose Piconet network the mobile telephone 30 is linked. The RF unit 31 and the mobile telephones 30 located on the same floor form a Piconet network, which is connected to a computer 34 responsible for group control of the elevator system. The connection from the RF unit 31 to the control computer 34 can be arranged e.g. via a USB bus or a serial port. In large lobbies it is useful to mount several RF units 31 to allow the location of the customer to be known with a rough accuracy. This location data can be utilized to guide the customer to the right elevator 36.

The passenger gives his/her destination floor in the elevator lobby using the keypad of his/her mobile telephone 30 and application software produced by the elevator manufacturer or some other party. As the departure floor is identified by the Piconet network to which the mobile telephone 30 is linked, the source floor—target floor pair is known, on the basis of which it is possible to perform elevator allocation and thus select the best elevator for the customer. Information regarding the arriving elevator and its location in large lobbies relative to the passenger as well as an estimated waiting time can be presented on the display of the mobile telephone 30. The information transmitted may be e.g. as shown on display 11. When the elevator arrives at the floor, in addition to the normal signal lights 37 (arrow lights e.g. above or beside the elevator door 36), the passenger can be given e.g. a sound signal or other signaling via the mobile telephone 30. The system also comprises up-down call buttons 38, which are needed for passengers not registered in the call system.

If the passenger is a regular user of the elevators in the building, i.e. a so-called long-standing customer, then it is possible to give to the user's mobile telephone as a default alternative the destination floor most frequently selected by the user from the floor in question. In this case, by just pressing a button, the user can accept or reject the default destination floor given.

In an embodiment of the present invention, in an office building with many companies it is possible to present on the display of the mobile telephone a list of all the companies working in the building. The elevator user can select from this list the target company he/she is going to. Having received the call data and allocated an elevator, the control system can send over the Internet 32 information regarding the identity of the guest or worker to the receptionist of the company concerned. This gives the possibility that, depending on the waiting and ride time of the arriving customer, the company can have people waiting e.g. for an arriving guest in their lobby somewhat beforehand. This application requires that the company in question has bought from the maintainer of the elevator system a right to use the service. In practice, this right can be acquired by registering to the web server 33 on the same principle as the elevator customer was registered as a user.

The elevator cars can also be provided with RF units. This makes it possible to send to the elevator customers' mobile telephones individual information about the destination e.g. in the form of guidance. In principle, the present Bluetooth technology also allows the transmission of advertisements to the mobile telephone.

As an embodiment, individual and personal passenger guidance can be implemented in high-rise buildings, which may contain several separate elevator systems. Guidance is required if the customer has to transfer from one elevator group to another during his/her trip. When the customer arrives to the area of a new Piconet network after an elevator trip, he/she will be located and the customer can be guided personally forward towards the next elevator group and the elevator allocated to the passenger. A call for an elevator providing a continuation connection can be made automatically when the system detects the arrival of the customer in the area of the next elevator group.

The computer 34 controlling the system can be connected to the Internet 32 by linking an embedded mobile telephone 35 to the computer. By means of this mobile telephone, the elevator control system can communicate with other functions in the building. Connected to the processors controlling the functions are mobile telephones which again can be used to establish a connection to the Internet 32, over which the various functions can transmit data to each other. Thus, the user of the elevator system can be provided diversified services, in which it is possible to utilize the customer location data given by a short range Piconet network (using a radio transmitter-receiver typically with an operating range of 10 m).

It is obvious to the person skilled in the art that the invention is not limited to the embodiments described above, in which the invention has been described by way of example, but that many variations and different embodiments of the invention are possible within the scope of the inventive concept defined in the claims presented below.

The invention claimed is:

1. A method for wireless input of a call in an elevator system, said method comprising:

establishing a connection between a wireless terminal of the person inputting the call and the control system of the elevators;

identifying the person inputting the call and the departure floor of the person inputting the call and selecting the user profile of the person inputting the call from the control system;

sending from the control system to the terminal those parts of the user profile that contain building and departure floor specific destination floor alternatives;

programming one or more user-specific and building-specific destination floor alternatives into the wireless terminal for use by user selection subsequent to the programming, said programming allowing for user-initiated addition and deletion of building-specific destination floor alternatives to and from the terminal;

inputting a destination floor call by means of the wireless terminal from among the aforesaid destination floor alternatives; and transmitting the destination floor call to the control system of the elevators for elevator allocation.

2. A method according to claim 1, wherein said user profile contains information regarding earlier destination floor selections made by the person inputting the call, the number of floors in the building, floor designations and services activated for the person inputting the call.

3. A method according to claim 2, wherein said information regarding the floor designation is the name of a company or community working on that floor.

4. A method according to claim 1, wherein said wireless terminal is a mobile telephone.

5. A method according to claim 1, wherein said wireless terminal is a RFID transponder.

6. A method according to claim 1, wherein data transfer between the elevator system and the wireless terminal takes place in accordance with the Bluetooth standard.

7. A method according to claim 1, said method further comprising:

gathering user and building specific statistical information regarding the user's destination floor selections from different departure floors; and sending to the terminal as quick selection alternatives the user's most frequent destination floor selections from the floor being considered.

8. A method according to claim 1, said method further comprising:

receiving identifier data related to the building when the terminal is located in a desired building; and programming one or more building-specific destination floor alternatives into the terminal on the basis of the aforesaid identifier data independently of the location of the terminal at the time of programming.

9. A method according to claim 1, said method further comprising:

transmitting the aforesaid call information between the wireless terminal and the elevator system via a base station; and placing at least one base station on each floor in the building.

10. A method according to claim 1, said method further comprising:

transmitting after allocation of an elevator information regarding the elevator to serve the call to the aforesaid terminal.

11. A method according to claim 1, said method further comprising:

transmitting information relating to elevator service to the aforesaid terminal after allocation of an elevator.

12. A method according to claim 11, wherein said information relating to elevator service is an estimated passenger waiting time.

13. A method according to claim 11, wherein said information relating to elevator service is guidance information guiding the passenger to the elevator allocated to the person inputting the call.

14. A method according to claim 1, wherein the user profile includes a possibility to activate and deactivate personal services related to traveling by elevator.

15. A method according to claim 1, said method further comprising:

placing RFID resonant circuits in the terminal; and giving a destination call selection by closing a desired resonant circuit by means of a switch.

16. A method according to claim 1, said method further comprising:

connecting the control system, the aforesaid terminal and at least one company or community located in the service area of the elevator system to a network providing services.

17. A method according to claim 16, wherein said network is the Internet.

18. A method according to claim 16, said method further comprising transmitting to the aforesaid company or community connected to the network advance information about an arriving passenger after a destination floor call to the floor where the aforesaid company or community is located has been input.

19. A method for wireless input of a call in an elevator system, said method comprising:

establishing a connection between a wireless terminal of the person inputting the call and the control system of the elevators;

identifying the person inputting the call and the departure floor of the person inputting the call and selecting the user profile of the person inputting the call from the control system;

sending from the control system to the terminal those parts of the user profile that contain building and departure floor specific destination floor alternatives;

inputting a destination floor call by means of the wireless terminal from among the aforesaid destination floor alternatives;

programming a building-specific destination floor alternative into the system by a substantially longer depression of a call input button than in the case of a destination floor selection; and transmitting the destination floor call to the control system of the elevators for elevator allocation.

20. A method for wireless input of a call in an elevator system, said method comprising:

establishing a connection between a wireless terminal of the person inputting the call and the control system of the elevators;

identifying the person inputting the call and the departure floor of the person inputting the call and selecting the user profile of the person inputting the call from the control system;

sending from the control system to the terminal those parts of the user profile that contain building and departure floor specific destination floor alternatives;

inputting a destination floor call by means of the wireless terminal from among the aforesaid destination floor alternatives by placing bar codes on the terminal;

giving a destination call selection by showing a desired bar code to an optical bar code reader; and transmitting the destination floor call to the control system of the elevators for elevator allocation.

21. A system for wireless input of a call in an elevator system, said system having at least one elevator, and a control system controlling the elevators; said system further comprising:

a wireless terminal for the input of a call;

a base station for establishing a connection and transmitting information between the wireless terminal and the elevator control system;

identification data for identification of the person inputting the call and the departure floor and a user profile in the control system, said user profile containing building and departure floor specific destination floor alternatives;

a first programming means for programming one or more user-specific and building-specific destination floor alternatives into the wireless terminal for use by user selection subsequent to the programming, said programming allowing for user-initiated addition and deletion of building-specific destination floor alternatives to and from the wireless terminal;

call input means in the wireless terminal for inputting a destination floor call from among the aforesaid destination floor alternatives; and call transmission means for transmitting the destination floor call to the control system of the elevators for elevator allocation.

22. A system according to claim 21, wherein said user profile contains information regarding earlier destination floor selections made by the person inputting the call, the number of floors in the building, floor designations and services activated for the person inputting the call.

23. A system according to claim 22, wherein the information regarding the floor designation is the name of a company or community working on that floor.

24. A system according to claim 21, wherein said wireless terminal is a mobile telephone.

25. A system according to claim 21, wherein said wireless terminal is a RFID transponder.

26. A system according to claim 21, wherein data transfer between the elevator system and the wireless terminal takes place in accordance with the Bluetooth standard.

27. A system according to claim 21, said system further comprising:

statistics for gathering user and building specific statistical information regarding the user's destination floor selections from different departure floors; and the aforesaid base station for sending to the terminal as quick selection alternatives the user's most frequent destination floor selections on the departure floor being considered.

28. A system according to claim 21, said system further comprising:

an identifier associated with the building and the aforesaid terminal for receiving the identifier when the terminal is located in a desired building; and second programming means for programming one or more building-specific destination floor alternatives to the terminal on the basis of the aforesaid identifier independently of the location of the terminal at the time of programming.

29. A system according to claim 21, said system further comprising:

at least one base station placed on each floor in the building for transmitting the aforesaid call data between the wireless terminal and the elevator system.

30. A system according to claim 21, said system further comprising:

data transfer means for transmitting to the aforesaid terminal after allocation of an elevator information regarding the elevator to serve the call.

31. A system according to claim 21, said system further comprising:

the aforesaid data transfer means for transmitting to the aforesaid terminal information relating to elevator service after allocation of an elevator.

32. A system according to claim 31, wherein said information relating to elevator service is an estimated passenger waiting time.

33. A system according to claim 31, wherein said information relating to elevator service is guidance information guiding the passenger to the elevator allocated to the person inputting the call.

34. A system according to claim 21, wherein the user profile includes a possibility to activate and deactivate personal services related to traveling by elevator.

35. A system according to claim 21, said system further comprising:

RFID resonant circuits placed in the terminal; and switches for giving a destination floor call by closing the switch for a desired resonant circuit.

36. A system according to claim 21, said system further comprising:

a network providing services for connecting the control system, the aforesaid terminal and at least one company or community located in the service area of the elevator system to each other.

37. A system according to claim 36, wherein said network is the Internet.

38. A system according to claim 36, said system further comprising:

means for transmitting to the aforesaid company or community connected to the network advance information about an arriving passenger after a destination floor call to the floor where the aforesaid company or community is located has been input.

39. A system according to claim 21, said system further comprising:

a server for registration into the system, use of the service, loading of additional services and storage of the user profile.

40. A system according to claim 21, said system further comprising:

an embedded mobile telephone for connecting the control system to the network providing services.

41. A system for wireless input of a call in an elevator system, said system having at least one elevator and a control system controlling said at least one elevator; said system further comprising:

a wireless terminal for the input of a call;

a base station for establishing a connection and transmitting information between the wireless terminal and the elevator control system;

identification data for identification of the person inputting the call and the departure floor and a user profile in the control system, said user profile containing building and departure floor specific destination floor alternatives;

call input means in the wireless terminal for inputting a destination floor call from among the aforesaid destination floor alternatives by bar codes placed in the terminal;

an optical reader for giving a destination call selection by showing a desired bar code; and call transmission means for transmitting the destination floor call to the control system of the elevators for elevator allocation.

* * * * *